US006688814B2

(12) United States Patent
Wetch et al.

(10) Patent No.: US 6,688,814 B2
(45) Date of Patent: Feb. 10, 2004

(54) ADJUSTABLE RIGID RISER CONNECTOR

(75) Inventors: Stephen B. Wetch, Sugar Land, TX (US); Michael Ernest Utt, Sugar Land, TX (US)

(73) Assignee: Union Oil Company of California, El Segundo, CA (US)

( * ) Notice: Subject to any disclaimer, the term of this patent is extended or adjusted under 35 U.S.C. 154(b) by 0 days.

(21) Appl. No.: 09/952,595

(22) Filed: Sep. 14, 2001

(65) Prior Publication Data

US 2003/0053868 A1 Mar. 20, 2003

(51) Int. Cl.[7] ..... F16L 13/06; E02B 17/00

(52) U.S. Cl. ..... 405/224.2; 405/195.1; 405/224.4; 166/355

(58) Field of Search ..... 405/195.1, 223.1, 405/224, 224.1–4; 166/350, 355, 356, 367; 175/5.7, 8; 114/264–267; 254/392

(56) References Cited

U.S. PATENT DOCUMENTS

| | | | | | |
|---|---|---|---|---|---|
| 3,528,497 | A | * | 9/1970 | Lehman | 175/7 X |
| 3,721,292 | A | | 3/1973 | Ahlstone | 166/5 |
| 3,721,293 | A | * | 3/1973 | Ahlstone et al. | 166/355 |
| 4,040,265 | A | | 8/1977 | Hellerman et al. | 61/91 |
| 4,097,069 | A | | 6/1978 | Morrill | 285/84 |
| 4,213,720 | A | | 7/1980 | Portass | 405/195 |
| 4,272,059 | A | | 6/1981 | Noerager et al. | 254/392 |
| 4,320,993 | A | | 3/1982 | Hunter | 405/224 |
| 4,330,140 | A | | 5/1982 | Hampton | 285/39 |
| 4,365,912 | A | | 12/1982 | Burns | 405/60 |
| 4,421,173 | A | * | 12/1983 | Beakley et al. | 166/355 X |
| 4,421,436 | A | | 12/1983 | Burns | 405/60 |
| 4,425,056 | A | | 1/1984 | Hunter | 405/224 |
| 4,468,157 | A | | 8/1984 | Horton | 405/224 |
| 4,511,288 | A | | 4/1985 | Wetmore | 405/217 |
| 4,597,595 | A | | 7/1986 | Wallace | 285/119 |
| 4,607,865 | A | | 8/1986 | Hughes | 285/18 |
| 4,616,708 | A | * | 10/1986 | da Mota | 166/355 |
| 4,646,841 | A | | 3/1987 | Schawann et al. | 166/355 |
| 4,660,677 | A | | 4/1987 | Hunter | 182/10 |
| 4,662,785 | A | | 5/1987 | Gibb et al. | 405/195 |
| 4,669,916 | A | | 6/1987 | White et al. | 405/224 |
| 4,780,026 | A | | 10/1988 | Gunderson | 405/224 |
| 4,781,497 | A | | 11/1988 | Karsan et al. | 405/202 |
| 4,784,529 | A | | 11/1988 | Hunter | 405/227 |
| 4,844,659 | A | | 7/1989 | Hunter et al. | 405/224 |
| 4,848,970 | A | | 7/1989 | Hunter et al. | 405/224 |
| 4,871,282 | A | | 10/1989 | Jennings | 405/224 |
| 4,881,852 | A | | 11/1989 | Gunderson | 405/224 |
| 4,883,387 | A | * | 11/1989 | Myers et al. | 405/224.4 |
| 4,934,871 | A | | 6/1990 | Kazokas, Jr. | 405/224 |
| 5,036,782 | A | | 8/1991 | Linde et al. | 114/65 |
| 5,092,711 | A | | 3/1992 | Langner | 405/169 |
| 5,125,709 | A | | 6/1992 | Meier, Jr. | 294/119.1 |
| 5,125,769 | A | | 6/1992 | Lee et al. | 405/204 |
| 5,147,149 | A | | 9/1992 | Craig et al. | 405/223.1 |
| 5,190,411 | A | | 3/1993 | Huete et al. | 405/223.1 |

(List continued on next page.)

FOREIGN PATENT DOCUMENTS

EP 1036914 * 9/2000

OTHER PUBLICATIONS

Veldman, Hans and Lagers, George, *50 Years Offshore*, 1997 Foundation for Offshore Studies, Delft, pp. 38–41.

*Primary Examiner*—Jong-Suk Lee
(74) *Attorney, Agent, or Firm*—Yale S. Finkle; Gregory F. Wirzbicki; William O. Jacobson

(57) ABSTRACT

A substantially rigid riser to offshore platform connector and a process of using the connector allows a riser to be preloaded and adjustably positioned relative to the offshore platform. The connector allows the riser tensile load to be limited by preloading and adjustably positioning the connector. In the preferred embodiment, hydraulic cylinders are used to preload the connector as well as to partially or fully support the riser during maintenance or repair procedures.

31 Claims, 2 Drawing Sheets

U.S. PATENT DOCUMENTS 5,222,560 A 6/1993 Brammer et al. ..... 166/344
5,310,007 A * 5/1994 Parikh ..... 166/355
5,324,141 A 6/1994 Hunter et al. ..... 495/223.1
5,421,676 A 6/1995 Wybro et al. ..... 405/223.1
5,439,321 A 8/1995 Hunter ..... 405/195.1
5,479,990 A * 1/1996 Peppel ..... 166/350
5,542,783 A 8/1996 Pollack ..... 405/223.1
5,551,802 A 9/1996 Wybro ..... 405/223.1
5,575,592 A 11/1996 Pollack ..... 405/223.1
5,634,671 A * 6/1997 Watkins ..... 285/18
5,671,812 A 9/1997 Bridges ..... 166/348
5,697,446 A 12/1997 Giannesini ..... 166/354
5,707,178 A 1/1998 Srinivasan ..... 405/223.1
5,755,607 A 5/1998 Boatman et al. ..... 441/5
5,873,678 A * 2/1999 Moses ..... 405/223.1
5,881,815 A 3/1999 Horton, III ..... 166/350
5,905,212 A * 5/1999 Moses et al. ..... 73/862.451
5,911,542 A 6/1999 Obrock et al. ..... 405/219
5,927,902 A 7/1999 Sveen et al. ..... 405/169
5,964,550 A 10/1999 Blandford et al. ..... 405/224
6,022,174 A 2/2000 Husvik et al. ..... 405/223.1
6,045,296 A * 4/2000 Otten et al. ..... 405/195.1
6,234,252 B1 5/2001 Pallini, Jr. et al. ..... 166/345
6,296,232 B1 * 10/2001 Roodenburg ..... 254/392
6,406,222 B1 * 6/2002 Pollack ..... 405/224
6,431,284 B1 * 8/2002 Finn et al. ..... 166/350

* cited by examiner

ADJUSTABLE RIGID RISER CONNECTOR

FIELD OF THE INVENTION

This invention relates to offshore platforms and drilling processes. More specifically, the invention is related to low-heave or heave-constrained buoyant platforms, such as tension leg platforms used to drill into and produce fluids from offshore hydrocarbon resources.

BACKGROUND OF THE INVENTION

Some offshore resource recovery activities, e.g., withdrawal of hydrocarbon fluids from a subsurface reservoir through underwater tubular risers to surface facilities, are typically accomplished using an offshore platform. The offshore platform supports at least a portion of the surface facilities and well tubulars while withstanding waves, wind, and other offshore environmental conditions. The offshore platform typically includes an above-water deck or other working platform for the placement of at least a portion of the resource recovery facilities. For offshore platforms located in shallow water depth locations, a generally rigid tower structure supports the working platform and is typically fixed to an underwater or seafloor anchor or foundation. For offshore platforms located in deeper waters, e.g., offshore platforms located in waters having a depth typically exceeding about 500 to 2000 feet (or about 150 to 600 meters), this type of fixed tower structure is typically not cost effective, and buoyant platforms or other types of resource recovery facilities are more likely to be used.

Drillships or other buoyant platforms typically use one or more buoyant hull portions to support the risers and other resource recovery facilities, but buoyant platforms are susceptible to significant positional variations due to wave and wind actions, e.g., up and down position variations or heave motions. A low-heave buoyant platform can be achieved by using various design options, e.g., semi-submersible spars, deep draft flotation elements, and increased skin friction devices. However, some amount of heave motions must still be accommodated by low-heave platforms.

Tension leg platforms (TLPs) are a type of heave-constrained offshore structure that also incorporates one or more buoyant portions, but includes tension cables, tubulars, or other heave restraint means attached to the platform and extending generally downward toward a seafloor or other underwater anchor, typically secured by subsurface piles. These substantially vertical or heave restraint means are sometimes called tendons. The tendons are typically placed in tension, e.g., to provide resistance to the buoyant or heave forces on the submerged hull portions at essentially all times during resource recovery operations. When compared to some other buoyant or semi-submersible platforms, the tendons of a TLP greatly limit heave motions due to waves and other environmental forces that tend to vertically displace the buoyant portions of the TLP, but do not entirely eliminate all platform motions.

Unless otherwise restrained or controlled, significant lateral offset motions of the working platform of a TLP are typically still present in deep water applications due to the variations in wind, waves, tides, currents, and other environmental forces. The tendons of a TLP may provide some added restraint and stability in pitch, roll, or other motions, especially if relatively stiff tendons are used, but some pitch, roll and other motions of a TLP are typically present. The tendon-restrained TLP in deep water moves somewhat like a parallelogram-like structure with pinned corners when the TLP is exposed to lateral offset forces. With significant lateral forces and platform offset motion, the upper portion of the TLP "setsdown" (i.e., the upper buoyant portion tends to be pulled downward by the tendons when the upper portion is laterally offset), thus lowering the position of the partially submerged buoyant portion relative to the waterline. In addition to increases in wave height and/or mean water levels due to extreme environmental conditions, this lateral offset and lowering tends to create increased buoyant forces and increased riser tension.

Because extreme environmental conditions might impose unacceptable tensile loads on a riser fixedly attached to a heave-constrained platform, dynamic riser connectors and tensioning equipment have typically been used. The dynamic riser tensioning equipment allows relative vertical motion between the riser and platform while maintaining a generally constant tensile force on the riser. Such equipment can comprise hydraulic cylinder(s) with a piston and rod end attached to the riser and the cylinder attached to the platform so that a substantially constant tensile force is applied on the riser generally independent of the position of the piston(s) within the cylinder(s).

However, flexible pipe connections and dynamic riser tensioners typically provide relatively little additional lateral or other motion constraint when compared to fixed connections. A platform with flexible pipe or dynamic riser connections may require additional tethers, mooring cables or other means for providing further resistance to the lateral, pitch, roll or other motions. In addition, dynamic riser connections limiting the tension on the risers of a TLP may transfer excessive peak and/or jerk loads onto the tendons when the TLP is exposed to extreme (e.g., high wind and wave) environmental conditions or a failure of the dynamic riser connection. Dynamic riser tensioners can also add significant cost and complexity to the riser system.

SUMMARY OF THE INVENTION

One embodiment of the present invention provides a substantially fixed position, but adjustably located riser connector and a process for adjustably locating and fixedly connecting a riser to a buoyant platform. The preferred process positions and preloads the riser/connector, fixedly supports the riser, removes the preload, and allows later repositioning of the connector without the use of a drill rig. The substantially rigid riser connection provides increased stability and motion restraint while the connector preloading and repositioning capabilities limit riser and/or tendon loads to safe levels. The preferred riser connector comprises a nut threadably attachable to a riser length adjustment spool, means for adjusting the axial position of the nut relative to the riser, means for pre-loading the nut and/or riser, and means for removing the preload. The means for pre-loading and removing the preload is preferably by pressurizing and depressurizing a plurality of fluid or hydraulic actuators contacting the nut. The means for position adjusting is preferably a motor-driven support ring rotator and a plurality of support bars connected to the nut. The support bars preferably have overall length dimensions comparable to the length of the hydraulic actuators, allowing one or more hydraulic actuators to be relocated and to temporarily support a portion of the riser tensile load.

BRIEF DESCRIPTION OF THE DRAWINGS

In these Figures, it is to be understood that like reference numerals refer to like elements or features.

DETAILED DESCRIPTION OF THE INVENTION

Figure 1:
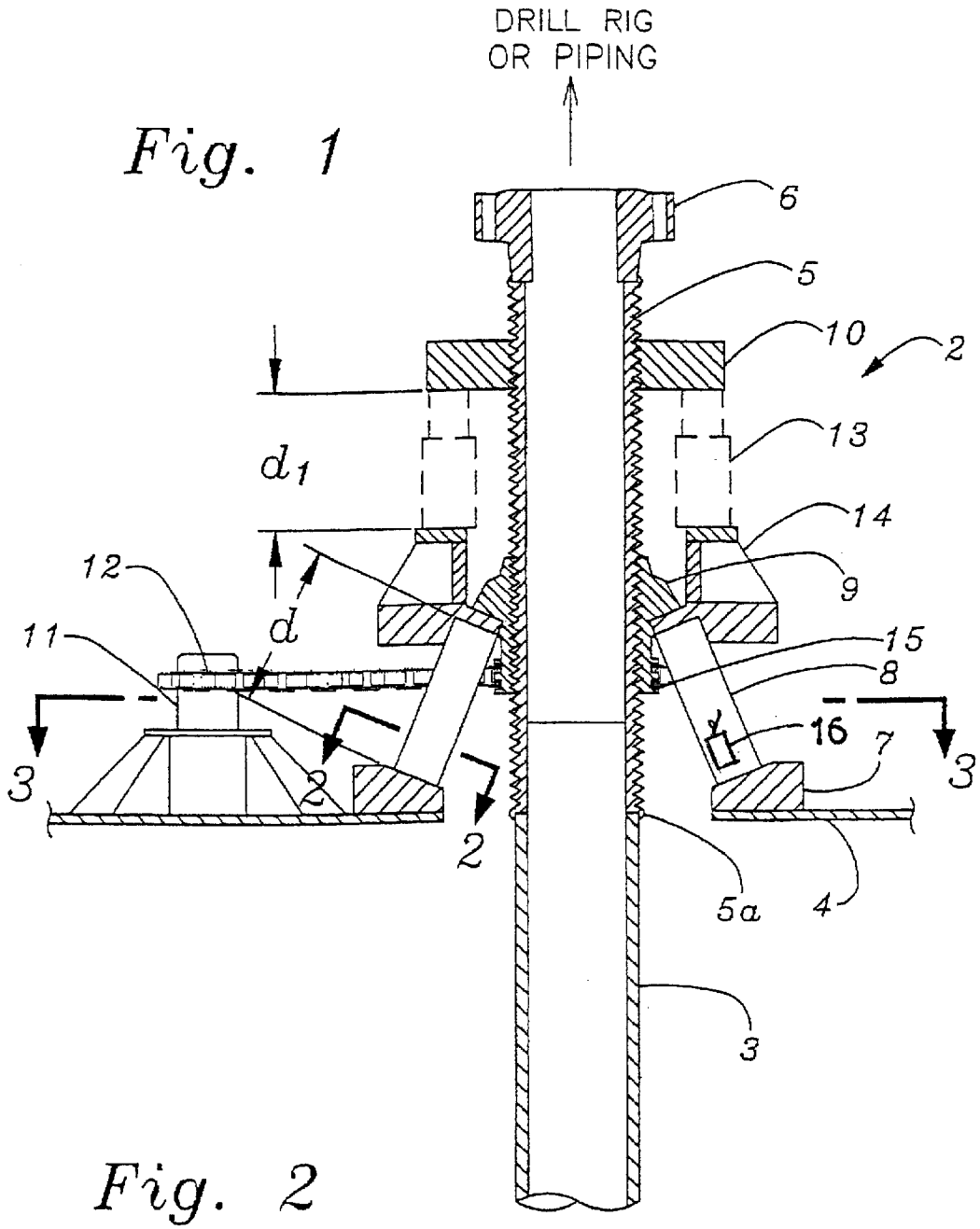
FIG. 1 shows a side cross-sectional view of an embodiment of the riser connector invention.

FIG. 1 shows a side cross-sectional view of a preferred connector assembly 2. The connector assembly 2 supports a generally downward load of a riser assembly 3 from a working platform or deck 4 of an offshore platform, such as a TLP or other buoyant platform. Riser assembly 3 is preferably composed of a plurality of tubular sections extending towards the sea floor, a weldably connected length adjustment spool 5 connected to an upper end of a tubular section at weld 5*a,* and a flange or other end connector 6 preferably welded to the other end of the length adjustment spool 5. Alternative embodiments of the invention may use threaded end connectors (instead of welded flange 6), externally grooved tubulars (instead of the threaded spool 5), or other means for attaching riser support connectors instead of the length adjustment spool and/or welded flange. FIG. 1 shows the connector assembly 2 after a drill rig, floating crane, workover rig or other means for installing or pulling the riser assembly 3 has been removed and before a fluid production tree or other piping has been connected to the flange 6. The means for installing or pulling the riser assembly 3 typically also includes means for removing riser sections, e.g., during initial installation and major maintenance activities.

Instead of a prior art dynamic tensioner or other slidably positioned connector supporting the riser assembly 3 from working platform 4, the embodiment of the inventive connector assembly 2 shown supports the riser assembly by a location adjustable, but otherwise fixed-position riser connector assembly. The riser connector assembly 2 preferably comprises a load support base or support ring 7 (placed on or attached to the working platform 4), six legs or bar assemblies 8 (instrumented with load cells 16 to measure forces acting on the bar assemblies) with one end contacting or connected to the load support ring 7, a pretension support ring 14 and load adjustment nut 9 connected to or contacting the other end of the bar assemblies 8 while being threadably engaged with the length adjustment spool 5.

The rotatable load adjustment nut 9 includes an interior or female thread that mates with an external or male thread on the length adjustment spool 5 to form a coupling of the connector assembly 2 supporting the riser assembly 3. The load adjustment nut 9 is preferably composed of carbon steel, but may also be composed of a corrosion-resistant metal or other structural materials. The coupling is preferably dimensioned to produce a moderate tolerance fit such as not to cause unusual machining cost or fabrication complexity yet provide adequate load capability and fatigue resistance. Although active lubrication of the mating threads of the coupling is not typically required, lubrication may be desirable for some applications in order to allow a motor 11, a chain drive 12, and a sprocket 15 to more easily rotate (and translate) the attached load adjustment nut 9 on the threaded length adjustment spool 5. In addition, the mating threads of the coupling preferably include a corrosion inhibiting coating, such as a low-friction plastic or metal coating, also tending to avoid the need for active lubrication.

Although the load adjustment nut 9 is typically in a substantially fixed position when supporting the load of the riser assembly 3, a means for rotating the load adjustment nut allows the load adjustment nut to be variably located along at least a portion of the length adjustment spool 5 especially when other support means carry the load of the riser assembly. The preferred means for rotating the load adjustment nut 9 include an electric or hydraulic motor 11 geared to provide sufficient torque to engage/disengage and rotate the threaded load adjustment nut through the chain drive 12 and sprocket 15. The motor-driven rotation causes axial translation of the load adjustment nut 9 along at least a portion of the length adjustment spool 5.

In an alternative embodiment of the invention, the pre-load support ring 10 and/or load adjustment nut 9 may be manually located and/or repositioned with torque bars or wrenches along the length adjustment spool 5 when the riser assembly 3 is temporarily supported by other means. The load adjustment nut 9, the pre-load support ring 10 or other riser support means can be adjustably positioned in alternative embodiments by rotating a threaded ring using hydraulic or electrical actuators (e.g., instead of a motor 11), providing a series of grooves on a length adjustment spool mating to a split or clamshell-type load support element (instead of a threaded load adjustment nut 9 and mating spool 5), or using a series of blocks to support a load support ring at different axial positions. Some of the alternative embodiments, e.g., grooved support elements, may be especially applicable to floating platforms that are subject to motions resulting from changes in wind and/or wave directions.

The preferred embodiment of the connector assembly 2 allows the tensile loads on the riser assembly 3 to be supported, at least in part, at the load adjustment nut 9 and/or at the pre-load support ring 10 as well as temporarily at the flange 6. The multiple riser support locations allow transfer of riser assembly loads, positional adjustment of one support point when the riser assembly is supported at another support point, and preloading of one of the riser support elements prior to the transfer of riser loads. In an alternative embodiment, another riser support area is provided, e.g., by using a second load adjustment nut 9 mated to the riser assembly 3.

In the absence of a drill rig or other means for installing and removing the riser assembly 3, temporary load support and preloading is preferably accomplished using multiple hydraulic actuators or cylinders 13 shown dotted in FIG. 1 after a drill rig has been removed. The hydraulic actuators 13 each contain a piston and shaft capable of being driven in either direction by pressurized hydraulic fluid. With hydraulic or other fluid pressures ranging as high as about 3000 psig, but more typically about 2000 psig, the hydraulic actuators 13 are capable of supporting tensile or compressive loads of about 200 kips or more over a range of piston positions. For deeper water, compressive or tensile loads of at least about 600 kips should be expected. The piston and shaft within the hydraulic actuators 13 are preferably capable of being driven over a distance of at least about 2 inches (or 5 cm), more preferably a distance of at least about half the diameter of the riser assembly 3, and still more preferably over a distance of at least about 10 inches or 25 cm. In alternative embodiments, electrical actuators, mechanical jacks, or other means for temporarily supporting the riser assembly 3 can be used in place of the hydraulic actuators 13.

The hydraulic cylinders 13 and bar assemblies 8 are preferably connected or removably attached to the pre-load support ring 10, pretension support ring 14 and/or load support ring 7. Alternative means for connecting or attaching the hydraulic cylinders 13 and/or bar assemblies 8 can include welding or more permanent attachment. Also, instead of being connected or removeably attached, the cylinders and bar assemblies may contact and bear against the pre-load support ring 10, pretension support ring 14 and/or load support ring 7. The load cylinders 13 and pre-load support ring 10 (which is preferably a removable split ring) are portable and useable for different riser assemblies as part of a riser adjustment tool assembly on the buoyant platform 4. The bar assemblies 8 are also preferably portable and usable for other applications.

In one embodiment, the bar assemblies 8 transmit riser loads over an adjustable bar length or dimension "d" between load adjustment nut 9, pretension support ring 14 and load support ring 7. Although bar dimension "d" may be as small as a few inches or less, the bar dimension preferably ranges from about 1 to 3 riser diameters or more for connector assemblies 2 on a low-heave platform in typical deep water applications. In other embodiments and applications, the bar assemblies 8 can be omitted, e.g., with an alternative load adjustment nut bearing directly against the load support ring 7 or platform 4. In an alternative embodiment, solid bars (instead of the bar assemblies 8) having a fixed length or dimension "d" or several sets of fixed length bars (each set having a different dimension "d") are used. In yet another alternative embodiment, a modified load adjustment nut and ring may avoid the need for a separate pretension support ring 14. For example, the modified load adjustment nut 9 would include a ring-like bearing surface such that the bar assemblies 8 directly transmit loads between load support base 7 and the modified load adjustment nut. In this alternative embodiment, the bar dimension "d" may have to be changed to accommodate the dimensions of the modified load adjustment nut and bearing surface. In still another alternative embodiment, the load adjustment nut 9 would bear against a modified pretension support ring having a shape that allows other positions and adjustments of the bar assemblies 8, load cylinders 13, and the varying of dimensions "d" and "d1."

In a preferred process of using the connector assembly 2, a drilling rig or other means for temporarily supporting the riser assembly 3 in an initial position is attached to flange 6 while the load adjustment nut 9, preload support ring 10, and/or bar assemblies 8 are adjusted and set in a desired position relative to the riser assembly. After the riser assembly 3 is set in its initial position, a preload force is preferably applied to load adjustment nut 9, preload support ring, and/or riser assembly 3 by means of the drilling rig and/or the hydraulic cylinders 13.

The preferred preload force is sufficient to place the load adjustment nut 9 in a desired position with respect to the platform 4 after the temporary support of the riser assembly 3 and/or the preload force (e.g., applied by hydraulic cylinders 13) are removed and the riser assembly 3 is supported by the load adjustment nut in a substantially fixed location. If the hydraulic cylinders 13 are used to apply the preload, the preload can be measured by the fluid pressure in the hydraulic cylinders or more directly by the load cells 16 on the bar assemblies 8.

A source of pressurized fluid supplies the hydraulic cylinders 13, preferably on the cylinder side, resulting in a pushing outward or a cylinder-rod-extending preload having a component in a vertical direction between the load adjustment nut 9 and pre-load support ring 10. In alternative embodiments of the connector assembly 2, other means for preloading can be used, e.g., replacing the hydraulic actuators 13 and associated load transfer elements with wedges, mechanically operated jacks, threadably extendable legs (similar to the bars 8), or fluid actuated telescoping supports.

In a preferred embodiment, riser preloads are preferably tensile loads equal to or greater than the buoyant weight of the riser assembly 3, but preloads or pretension forces more preferably range from about 100,000 pounds more than the buoyant weight of the riser assembly to about twice the buoyant weight of the riser assembly or more. For a TLP in about 3,000 feet of water having a 13⅜ inch nominal diameter riser assembly with internal casing and tubing, a preferred preload for the riser assembly 3 ranges from about 600,000 pounds up to an extreme load of about 1,000,000 pounds. In other applications, the preload and/or supporting forces may be significantly larger or smaller, but the preload is typically substantial, e.g., greater than about 10,000 pounds.

The hydraulic actuators 13 transmit the preload forces between the pre-load support ring 10 and pretension support ring 14 over the actuator dimension "d1," which is preferably in the same range of dimensions as the bar dimension "d." However, the hydraulic actuator dimension "d1" can range from about a few inches or less to 36 inches or more, more typically ranging from at least about 6 inches to about 24 inches. If dimensionally similar, the hydraulic actuators 13 and bar assemblies 8 can be interchanged so that (if desired) the riser assembly 3 may be fully or partially supported from the pre-load support ring 10 or load adjustment nut 9 using the hydraulic actuators. Interchangeability may only require a partial overlap in the range of length dimensions of the hydraulic actuators 13 and the bar assemblies 8. In still other alternative embodiments, actuator dimension "d1" can be increased or decreased to accommodate the expected changes in the position of the pretension support ring 14 and/or load adjustment nut 9 without being interchangeable with the extendable length "d" of the bar assemblies 8.

A preferred procedure for positioning, connecting, and fixedly supporting the riser assembly 3 to the working platform 4 begins with adjusting the vertical position of load adjustment nut 9 (using motor 11, chain drive 12, and sprocket 15) while the riser assembly 3 is at least partially supported by other means, such as a drilling rig or hydraulic cylinders 13. After positioning and/or pre-loading the connector assembly 2 and the length adjustment spool 5 using the hydraulic cylinders 13, the drilling rig or other temporary means for supporting riser assembly 3 is unloaded and removed, thereby transferring substantially all of the riser assembly load to the bar assemblies 8. If the preloading process is accomplished using the hydraulic cylinders 13, the preloading on adjustment nut 9 can be removed by reducing the fluid pressure within the cylinders, and the cylinders swung out of the way and disconnected, creating a substantially rigid riser-to-platform connection that supports a load comprising at least a substantial portion of the buoyant weight of the riser assembly 3 plus any desired tension on the riser assembly. During the riser assembly 3 installation/positioning/preloading/supporting procedure as well as during resource recovery operations, data from the load cells 16 on the bar assemblies 8 are preferably monitored to assure a safe and reliable transfer of the support loads, preloads, and tensioning loads on the riser assembly and the load support ring 7.

In addition to removing the hydraulic cylinders 13, the pre-load support ring 10 and/or a modified pretension support ring 14 may also be removed if no longer required after the preloading process. Removal of the hydraulic cylinders 13, pre-load support ring 10, and the modified pretension support ring allows them to be used for other purposes during other resource recovery operations. For example, the load hydraulic cylinders 13 can be used to adjust the position of other riser assemblies as a portable jacking/preloading tool package on the platform 4.

Figure 2:
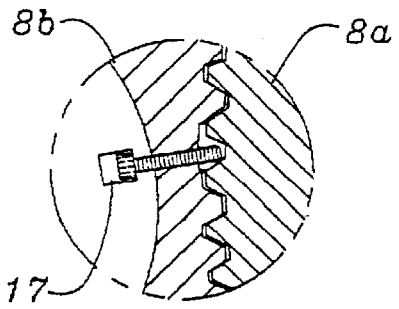
FIG. 2 shows the cross sectional detail of the bar shown in FIG. 1 at section 2—2.

FIG. 2 shows a partial cross-section view of a detail of an adjustable bar assembly 8 at section 2—2 shown in FIG. 1. The adjustable or extendable bar assembly 8 shown comprises a threaded male element 8*a* and a mating female threaded element 8*b,* allowing the bar assembly to extend and retract over a range of bar dimensions "d" (shown in FIG. 1) by differentially rotating the male and female elements. The bar dimension "d" is preferably altered by rotating the male element 8*a* with respect to the female element 8*b* while the riser assembly 3 (see FIG. 1) is at least partially supported by other means. Once differential rotation of the male element 8*a* and the female element 8*b* obtains a desired bar dimension "d," a set screw or other type of release fitting 17 is preferably set to substantially prevent differential rotation of the male and female elements and to substantially fix the desired bar dimension "d" prior to the riser load being applied.

Figure 3:
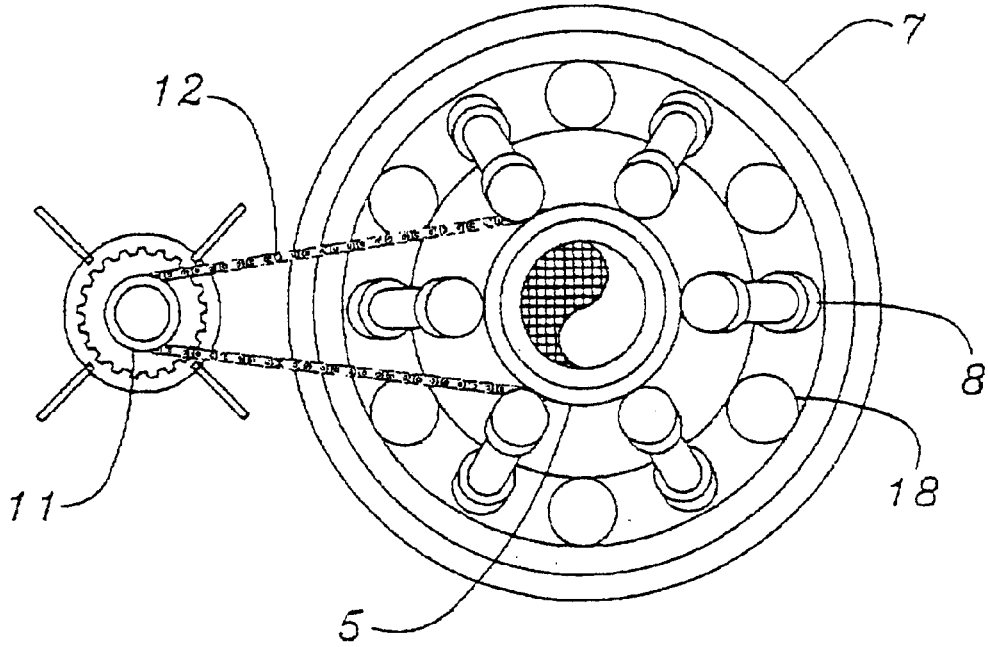
FIG. 3 shows a cross sectional top view of the riser connector shown in FIG. 1 at section 3—3.

FIG. 3 shows a cross-sectional view at section 3—3 as shown in FIG. 1. The preferred support ring 7 has twelve support indentations 18, six of which (in an alternating pattern) are preferably used to contact and support the bar assemblies 8. The other six indentations 18 may be used to support other bar assemblies 8 or the hydraulic cylinders 13 in other embodiments, e.g., during maintenance or other resource recovery operations. Something other than six of the twelve indentations 18 may be used to support the bar assemblies 8 in other applications or embodiments.

With reference to FIGS. 1 and 3, multiple hydraulic cylinders 13 can be used in another alternative embodiment instead of the preferred six bar assemblies 8. The multiple hydraulic cylinders 13 provide a generally constant load support for the riser assembly 3 in response to platform motions instead of the generally fixed position support in the preferred embodiment. In this alternative embodiment, all six bar assemblies 8 of the preferred embodiment are replaced with six or more hydraulic actuators 13 connected to a pressurized fluid supply. This substitution provides dynamic support capability by use of the pressurized hydraulic actuators or load cylinders 13 to adjustably position riser assembly 3. Once this substitution is completed the substituted hydraulic cylinders combined with the six hydraulic cylinders contacting pre-load support ring 10 (as shown in FIG. 1), allow preload and/or support forces to be applied to more than one point on the load adjustment spool 5. If substantially constant fluid pressures are maintained in all of the hydraulic cylinders 13, tensile loads on the riser assembly 3 are maintained substantially constant even as the relative vertical or lateral positions of the riser assembly and TLP change. In still other embodiments, adjustable mechanical springs or other "dynamic" motion load support devices and associated connectors can be used in place of some or all of the hydraulic actuators 13 and the associated connections.

In another alternative embodiment, some, but not all of the six preferred bar assemblies 8 are replaced with one or more hydraulic cylinders 13, providing a combination of generally rigid bar assemblies and dynamic load cylinders to at least partially support riser assembly 3 through load adjustment nut 9 and support base 7. This combination of rigid and dynamic supporting elements can be especially useful as a temporary arrangement for supporting riser assembly 3 if one or more of the bar assemblies 8 needs to be replaced or if a load cell on a faulty bar assembly needs to be calibrated or is not functioning properly. For example, two hydraulic cylinders 13 can be installed on either side of a faulty bar assembly. The two installed hydraulic cylinders 13 would then be supplied with pressurized fluid to at least accept the portion of the riser tensile preloads and/or bar compressive loads that would otherwise be supported by the faulty bar assembly 8. Pressurization of the adjacent load cylinders 13 would unload the faulty bar assembly and allow the unloaded faulty bar assembly to be replaced without requiring a drilling rig or other means for temporary riser assembly support.

On an offshore platform 4 having a plurality of the riser assemblies 3, a sufficient quantity of the bar assemblies 8 and hydraulic cylinders 13 would allow the potential for a temporary dynamic load support for a portion of the riser assemblies. Although the preferred embodiment provides a generally fixed support of the riser assemblies 3, dynamic support of some or all of the riser assemblies may be desirable during extreme environmental or other conditions that may tend to unacceptably displace the support position of one or more riser connections with respect to the platform. An alternative method of the invention would retain the hydraulic cylinders 13 (instead of removing them after the riser assembly 3 is fixedly supported) in order to provide greater flexibility for this type of load and positional support capabilities. This flexibility of the connector assembly 2 allows environmental/operational adaptability, repair, and/or replacement of components without the need for or cost of a drill rig.

In a preferred embodiment with separate risers and tendons on a TLP, the total downward load on a buoyant platform includes the forces from the connected tendons and the risers. The portion of the total load supported by the connector assemblies 2 may be a majority of the total riser and tendon loads. For example, the connector assemblies 2 can be set and preloaded to provide a greater tension in the riser assembly 3 and allow the tendon tension loads to be reduced. Although tendons may be sized for stiffness rather than load carrying capacity, this load sharing by the fixedly connected risers may allow reduced cost tendons and tendon connectors.

In addition to supporting multiple riser assemblies 3 from a platform 4, the preferred fixedly adjustable connector assembly 2 and riser connection method (including positioning and preloading the connector) of the invention may allow the risers to support all of or an adjustable portion of the total generally-downward tensile load on the entire platform. In some applications, the riser assemblies 3 can function as both fluid conduits (or risers) as well as tendons for a buoyant offshore platform, i.e., functioning as combined risers and tendons. In these applications, especially applicable if the wells are significantly spaced apart on the sea floor, the connector assembly 2 would support substantially all of the total tension load on the platform.

In another alternative embodiment, a connector assembly similar to the riser connector assembly 2 shown in FIG. 1 is also used to connect and support tendons anchoring a TLP. In this embodiment, each of the tubular tendons also has a welded length adjustment spool 5 at the upper end and is adjustably fixed to the TLP. This alternative riser and tendon connector embodiment allows for adjustment of the fixed position support and/or the dynamic support of both the riser and tendon tensile loads while providing further support flexibility and apportionment of the total tension loads on the TLP. This apportionment capability also provides further platform safety in that both the tendon and riser loads can be monitored (e.g., using load cells 16) and controlled within safe limits. Although this alternative embodiment uses tendon and riser connections adjustably similar to the riser connector assembly 2 shown, alternative means for adjusting the tendon tensile loads from a platform may also be used.

The inventive riser connection method has other advantages. These other advantages include allowing a rapid installation of a riser assembly (e.g., using motor 11 to rapidly position the connector assembly while the riser assembly 3 is temporarily supported during installation), avoiding the need for some wave compensation equipment (e.g., using hydraulic cylinders 13 to maintain generally constant tension during some wave conditions), allowing some repair or other work to be accomplished without requiring a drill rig or other means for temporary riser support (e.g., using the pre-load support ring 10 and platform jacks during repair or replacement of the load support ring 7 or other portions of the connector assembly 2), and increasing the safety of the platform, e.g., by positional adjustments to improve the capability to withstand extreme environmental conditions and allowing changes in the connector position/riser tension/natural frequency of the structure without the need for a workover rig or other means for pulling and installing a major portion of the riser assembly.

Additional advantages are possible for the alternative embodiment having adjustably fixed tendon and riser support connectors that also uses common outer diameter connectors and tubular sections for well risers, tendons, and length adjustment spools. Minimizing the number of different diameter connectors and tubular sections can reduce the number of handling tools, connector spare parts, and associated equipment on the offshore platform, thereby reducing the size and complexity of the platform and associated facilities. Some of these advantages would be present for applications having several different riser diameter tubulars if one of these tubular diameters is also used for the tendon sections. Some of these advantages would also be present if different wall thickness on common outer diameter tubing sections were used for the tendons and risers, e.g., handling equipment contacting the outside diameter of tubing sections could be the same even if different tubing wall thicknesses are used.

Still other alternative embodiments are possible. These include providing a removable motor 11, chain 12 and sprocket 15 assembly (with the assembly removed after initial connection and reinstalled when position adjustment or repairs are needed), adding tension load alarms based on load cell data, providing a pressurization controller and automatic pressurization of hydraulic cylinders 13 to load/reposition the riser connector based on bar assembly load cell data, computer-assisted tendon and riser tension loading procedures (e.g., using bar load cell data inputs to alter loading rates by means of software-controlled procedures), placing data collection, processing or other critical components in one or more protective enclosures to assure reliability, and integrating ballasting procedures with riser repositioning procedures.

Although the preferred embodiment of the invention has been shown and described, and some alternative embodiments also shown and/or described, further changes and modifications may be made thereto without departing from the invention. Accordingly, it is intended to embrace within the invention all such changes, modifications, and alternative embodiments as fall within the spirit and scope of the appended claims.

What is claimed is:

1. A connector for attaching a tubular assembly to a buoyant offshore platform located in at least about 150 meters of water, said connector comprising:

a coupling assembly connectable to at least one portion of said tubular assembly and said offshore platform wherein said coupling assembly is capable of applying a supporting force having an upward component to said tubular assembly at a substantially fixed position relative to said offshore platform; and a preloading assembly capable of simultaneously applying a substantial preloading force having an upward component to said tubular assembly in the absence of means for installing a portion of said tubular assembly.

2. The connector of claim 1 wherein at least a portion of said preloading force and at least a portion of said supporting force are capable of being applied at different locations on said tubular assembly.

3. The connector of claim 2 wherein said buoyant offshore platform is a heave-constrained platform and said tubular assembly comprises a plurality of fluid-conducting riser sections and said different locations on said tubular assembly are repositionable.

4. The connector of claim 3 which also comprises a plurality of bars contacting said coupling assembly and a support base over a bar length dimension that can be varied by at least about 2.5 centimeters.

5. The connector of claim 4 wherein said bars comprise a male threaded bar element and a mating female threaded bar element.

6. The connector of claim 5 which also comprises a pretension nut threadably attachable to said spool and connectable to said hydraulic actuators.

7. A connector for attaching a tubular assembly to a buoyant offshore platform, said connector comprising:

a coupling assembly connectable to at least one portion of said tubular assembly and said offshore platform wherein said coupling assembly is capable of applying a supporting force having an upward component to said tubular assembly at a substantially fixed position relative to said offshore platform; and a preloading assembly capable of applying a substantial preloading force to said tubular assembly in the absence of means for installing a portion of said tubular assembly wherein said coupling assembly comprises a threaded nut mating with a spool having external threads and said spool is attached to a riser section portion of said tubular assembly.

8. The connector of claim 7 which also comprises means which also comprises means for rotating said threaded nut relative to said spool.

9. The connector of claim 8 wherein said means for rotating comprises a motor and a chain drive connecting said threaded nut and said motor.

10. The connector of claim 9 wherein said preloading assembly comprises a plurality of hydraulic actuators capable of applying a preload force to said coupling assembly.

11. The connector of claim 10 wherein said hydraulic actuators have extendable dimensions that can be varied by at least about 5 centimeters.

12. The connector of claim 11 which also comprises a support ring adapted to transmit said supporting force and said preloading force.

13. The connector of claim 10 wherein said hydraulic actuators are capable of also being used to at least partially support said tubular at said substantially fixed position relative io said offshore platform.

14. The connector of claim 13 wherein said hydraulic actuators are capable of fully supporting said tubular assembly over a range of positions relative to said buoyant offshore platform.

15. A connector for attaching a tubular assembly through which subsea fluids can be produced extending from an underwater location to a buoyant platform located in at least about 150 meters of water, said connector comprising:

a coupling connectable to said tubular assembly and said offshore platform wherein said coupling is capable of applying a tensile force to said tubular assembly at a substantially fixed position relative to said platform; and means for adjusting said substantially fixed position in the absence of means for installing said tubular assembly wherein said means for adjusting comprises a rotatable threaded coupling actuated by a motor and said tubular is a riser wherein said tensile force is a preload at least equal to the buoyant weight of said tubular assembly and said means for adjusting is capable of relocating said substantially fixed position a distance of at least about 2.5 centimeters relative to said tubular assembly.

16. A connector for attaching a tubular to a platform at an offshore location having a water depth of at least about 150 meters, said connector comprising:

a coupling connectable to said tubular and said platform wherein said coupling is capable of applying at least a partially supportive force to said tubular; and a preloading assembly connectable to said coupling and capable of applying at least a substantial partially supportive force to said tubular.

17. The connector of claim 16 wherein said coupling applies said supportive force at a generally fixed tubular location and said preloading assembly applies said substantial force at a second tubular location spaced apart from said first location.

18. A riser to offshore platform connector comprising:

a riser support ring threadably attached to a riser assembly;

means for adjusting the axial position of the support ring relative to the riser assembly;

means for applying at least a substantially supportive preload force to the support ring in the absence of a drilling rig; and means for removing the preload force.

19. A riser to buoyant platform connector comprising:

a first riser support area capable of supporting the buoyant weight of a riser from means for installing said riser;

a second riser support area capable of supporting the buoyant weight of a riser from said platform at a first substantially fixed position relative to said platform in the absence of means for installing said riser;

a third riser support area capable of supporting the buoyant weight of said rise: at a second substantially fixed position relative to said platform spaced apart from said first substantially fixed position in the absence of means for installing said riser; and means for adjusting the position of at least one of said substantially fixed positions.

20. A connector for attaching a tubular assembly to an buoyant offshore platform located in at least about 150 meters of water, said connector comprising:

a coupling assembly connectable to at least one portion of said tubular assembly and said offshore platform wherein said coupling assembly is capable of applying a supporting force having an upward component to said tubular assembly at a substantially fixed position relative to said offshore platform; and a preloading assembly capable of applying a substantial preloading force having an upward component to said tubular assembly in the absence of at least a portion of said supporting force.

21. The connector of claim 20 wherein said preloading assembly is also capable of applying a substantial preloading force to said tubular assembly in the absence of means for installing a portion of said tubular assembly.

22. A process of attaching a riser to an offshore platform comprising:

connecting a support coupling from said offshore platform to said riser at a substantially fixed location relative to said platform while said riser is supported by other support means;

applying a substantial preload force having an upward component to said coupling;

removing at least a portion of said other support means such that said coupling is supporting at least a portion of said riser; and removing said preload force wherein said riser and coupling form a substantially rigid connection.

23. The process of claim 22 wherein said riser comprises fluid-conducting tubular sections having a centerline and said preload force is a tensile force substantially along said centerline.

24. The process of claim 22 wherein said riser comprises fluid-conducting tubular sections having a centerline and said preload force is a compressive force substantially along said centerline.

25. The process of claim 22 wherein said riser is connected to said offshore platform in the absence of wave compensation equipment.

26. A process of connecting a riser having a fluid-conducting axis to an offshore platform comprising:

supporting said riser using means for installing a riser;

positioning a riser connector adjacent to said riser, said riser connector capable of supporting said riser from said offshore platform;

applying an upward preloading force of at least about 10,000 pounds to said riser connector prior to said riser connector supporting said riser; and removing at least a portion of said preloading force after said riser connector is supporting at least a portion of the buoyant weight of said riser.

27. The process of claim 26 which also comprises the step of removing said means for installing a riser after said riser connector is supporting at least a portion of the buoyant weight of said riser.

28. The process of claim 27 which also comprises the step of monitoring the load supported by said riser connector.

29. The process of claim 28 wherein said riser connector is capable of supporting said riser at more than one location on said riser.

30. A connector for attaching a tubular assembly to a buoyant offshore platform located in at least about 150 meters of water, said connector comprising:

a coupling assembly connectable to at least one portion of said tubular assembly and said offshore platform wherein said coupling assembly is capable of applying a supporting force having an upward component to said tubular assembly at a substantially fixed position relative to said offshore platform; and a preloading assembly capable of applying a substantial preloading force having an upward component to said tubular assembly in the absence of means for installing a portion of said tubular assembly.

31. A connector for attaching a riser to a buoyant offshore platform located in at least about 150 meters of water, said connector comprising:

a coupling assembly connectable to at least one portion of said riser assembly and said offshore platform wherein said coupling assembly is capable of applying a supporting force having an upward component to said tubular assembly at a substantially fixed first position relative to said offshore platform; and a preloading assembly capable of simultaneously applying at a second position a substantial preloading force to said tubular assembly in the absence of means for installing a portion of said tubular assembly.

* * * * *

UNITED STATES PATENT AND TRADEMARK OFFICE

CERTIFICATE OF CORRECTION

PATENT NO. : 6,688,814 B2
DATED : February 10, 2004
INVENTOR(S) : Stephen B. Wetch et al.

It is certified that error appears in the above-identified patent and that said Letters Patent is hereby corrected as shown below:

Column 5,
Line 45, after "support ring" and before "," insert -- 10 --.

Column 8,
Line 36, after "riser" delete "assembly" and insert -- assemblies --.

Column 10,
Line 40, after "assembly" and before "wherein" insert -- , --.
Line 62, after "tubular" and before "at" insert -- assembly --.

Column 11,
Line 51, after "said" delete "rise:" and insert -- riser --.
Line 57, after "assembly to" delete "an" and insert -- a --.

Signed and Sealed this

Twenty-second Day of June, 2004

JON W. DUDAS
*Acting Director of the United States Patent and Trademark Office*